US006647977B2

(12) United States Patent
Lesage

(10) Patent No.: US 6,647,977 B2
(45) Date of Patent: Nov. 18, 2003

(54) TERMINATION UNIT FOR A COAXIAL FLUE PIPE

(75) Inventor: Claude Lesage, Pointe Claire (CA)

(73) Assignee: Giant Factories Inc., Montréal (CA)

( * ) Notice: Subject to any disclaimer, the term of this patent is extended or adjusted under 35 U.S.C. 154(b) by 243 days.

(21) Appl. No.: 09/888,157

(22) Filed: Jun. 25, 2001

(65) Prior Publication Data

US 2002/0195097 A1 Dec. 26, 2002

(51) Int. Cl.[7] ..... F23L 17/04

(52) U.S. Cl. ..... 126/85 B; 126/307 R; 126/307 A; 126/312

(58) Field of Search ..... 126/85 B, 312, 126/307 R, 80, 293, 307 A; 454/36, 35, 8

(56) References Cited

U.S. PATENT DOCUMENTS

| | | | | | |
|---|---|---|---|---|---|
| 217,712 | A | * | 7/1879 | Smith | 454/8 |
| 424,778 | A | * | 4/1890 | Gee | 454/237 |
| 757,348 | A | * | 4/1904 | Ross | 454/8 |
| 855,607 | A | * | 6/1907 | Baggaley | 454/116 |
| 2,766,677 | A | * | 10/1956 | Silverman | 454/8 |
| 2,818,060 | A | * | 12/1957 | Field | 126/307 R |
| 2,966,838 | A | * | 1/1961 | Thompson et al. | 454/8 |
| 2,998,764 | A | | 9/1961 | Bedell et al. | |
| 3,040,734 | A | * | 6/1962 | Field | 126/307 R |
| 3,052,230 | A | * | 9/1962 | Conrad | 126/307 R |
| 3,315,586 | A | * | 4/1967 | Marrapese et al. | 454/8 |
| 3,361,051 | A | * | 1/1968 | Fair er al. | 454/8 |
| 3,430,549 | A | * | 3/1969 | Hershey et al. | 454/8 |
| 3,435,816 | A | * | 4/1969 | De Werth | 126/85 B |
| 3,477,358 | A | * | 11/1969 | Howard | 454/10 |
| 3,691,930 | A | * | 9/1972 | Steinman | |
| 3,797,477 | A | * | 3/1974 | Ramey | 126/307 A |
| 3,874,363 | A | * | 4/1975 | Biedenbender et al. | 126/85 B |
| 4,940,042 | A | | 7/1990 | Moore, Jr. et al. | |
| 5,020,512 | A | * | 6/1991 | Vago et al. | 122/18.2 |
| 6,053,162 | A | * | 4/2000 | Godfree et al. | 126/85 B |

FOREIGN PATENT DOCUMENTS

| | | | |
|---|---|---|---|
| GB | 1386477 | * | 3/1975 |
| JP | 405026431 A | * | 2/1993 |
| JP | 407208732 A | * | 8/1995 |
| JP | 409318041 A | * | 12/1997 |

* cited by examiner

*Primary Examiner*—Carl D. Price
(74) *Attorney, Agent, or Firm*—Ogilvy Renault; Guy J. Houle

(57) ABSTRACT

A termination unit for a through-the-wall horizontal vent of a gas combustion device having a combustion chamber and a burner, is described. The termination unit comprises a wall mounting plate which is secured to a vertical wall outer surface and about an outer sleeve of a coaxial flue pipe. A fresh air chamber is secured to the wall mounting plate. An exhaust end of an exhaust flue pipe extends through the wall mounting plate and the fresh air chamber to exit through an outer wall of the chamber. Air intake ports are provided in an outer peripheral wall of the chamber to supply fresh air to a coaxial passage between the exhaust flue pipe and the outer sleeve to feed the combustion chamber. An air baffle is provided in the chamber about the exhaust end of the flue pipe and extends through the chamber. Wind deflector flanges are disposed in spaced relationship about the air intake ports of the chamber.

11 Claims, 3 Drawing Sheets

TERMINATION UNIT FOR A COAXIAL FLUE PIPE

TECHNICAL FIELD

The present invention relates to a termination unit for a through the wall horizontal vent of a coaxial flue pipe and wherein the termination unit is capable of dampening wind up to about 65 m.p.h. to prevent the pilot flame in the combustion chamber from extinguishing due to air disturbance propagating to the pilot flame.

BACKGROUND ART

Various types of termination unit designs are known and examples thereof are illustrated in U.S. Pat. Nos. 2,998,764, 4,940,042 and 3,435,816, which are believed to represent the closest prior art. All of these termination units are efficient in dampening wind striking against the unit in the area of the air intake but are efficient to a maximum wind speed of up to 45 m.p.h. On occasion, the pilot flame in a combustion furnace, hot water heater, etc., has been known to extinguish by a gust of air entering the termination unit, air feed conduit and propagating in a down draft to the pilot flame through the coaxial air feed passage. It is therefore desirable to provide a termination unit design which will be efficient in dampening wind at velocities higher than 45 miles per hour whereby to provide added security to combustion devices. If a pilot flame is extinguished, as is the case with some prior art designs, gas can infiltrate an area where the gas combustion device is used and could result in disastrous circumstances should the equipment not be provided with flame sensor and automatic gas shut-off valves. When the pilot is extinguished, there is often the need to have the burner serviced, and this is costly.

SUMMARY OF INVENTION

It is a feature of the present invention to provide a termination unit which substantially overcomes the disadvantages of the prior art and which is capable of dampening wind striking the termination unit at velocities of up to about 60 to 70 m.p.h.

According to the above feature, from a broad aspect, the present invention provides a termination unit for a through-the-wall horizontal vent of a gas combustion device having a combustion chamber and a burner. The termination unit comprises wall mounting means securable to a vertical wall outer surface and about an outer sleeve of a coaxial flue pipe. A fresh air chamber is secured to the wall mounting means. An exhaust end of an exhaust flue pipe extends through the wall mounting means and the fresh air chamber to exit through an outer wall of the chamber. Air intake ports are provided in an outer peripheral wall of the chamber to supply fresh air to a co-axial passage between the exhaust flue pipe and the outer sleeve to feed the combustion chamber. Air baffle means is provided in the chamber about the exhaust end of the flue pipe and extends through the chamber. Wind deflector means is disposed in spaced relationship about the air intake ports of the chamber.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
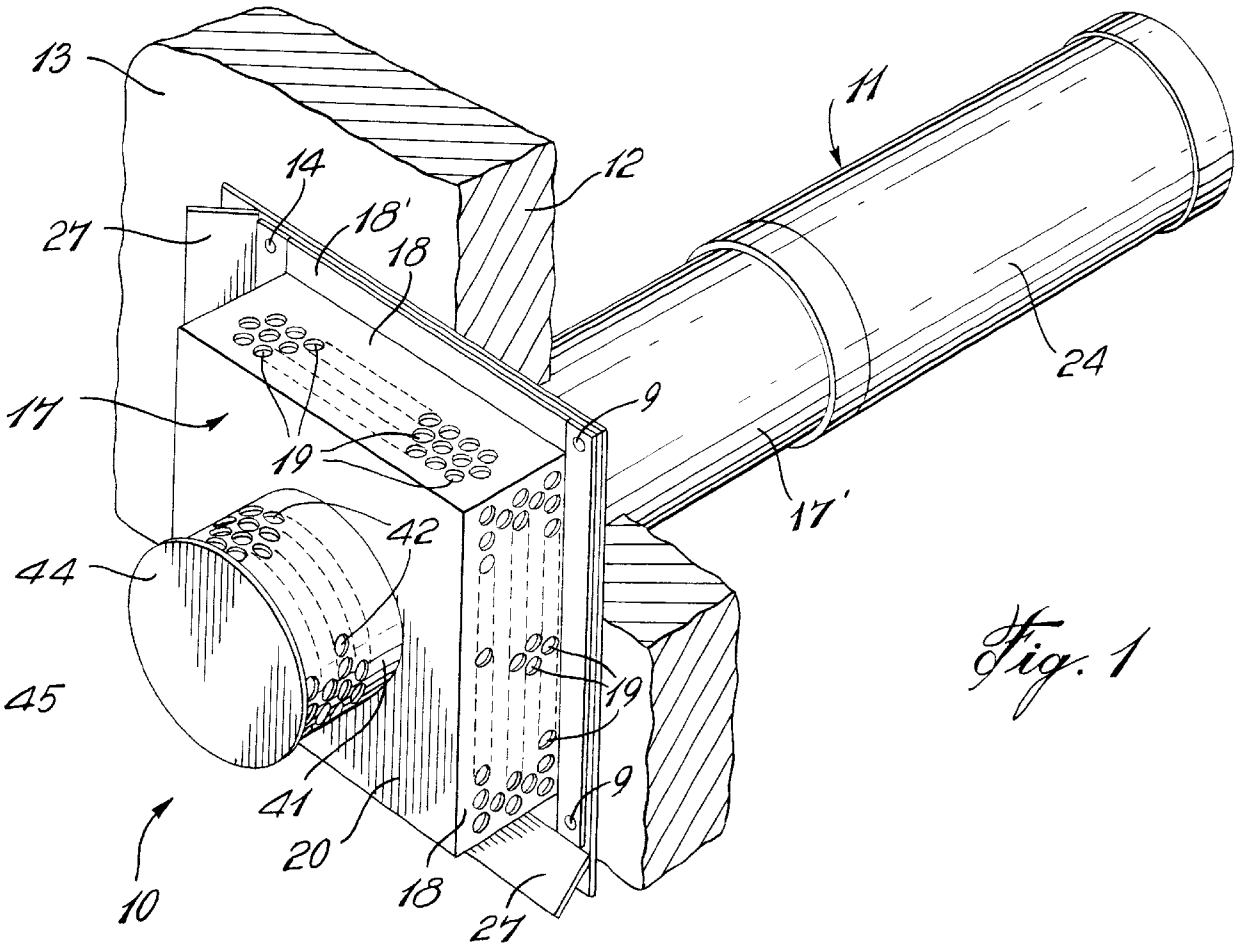
FIG. 1 is a perspective view illustrating the termination unit secured to the end of a coaxial flue pipe extending through a wall.

Referring now to the drawings and more particularly to FIG. 1, there is shown generally at 10 the termination unit of the present invention secured to a horizontal vent pipe 11 of a gas combustion device such as a fireplace, furnace, hot water heater, etc. which are provided with a combustion chamber and a burner, as is well known in the art. As hereinshown, the vent pipe 11 is a coaxial pipe and it extends through an outer wall 12 of a building structure. The termination unit 10 is secured to the outer face 13 of the outer wall 12 by fasteners 14 or other securement means.

Figure 2:
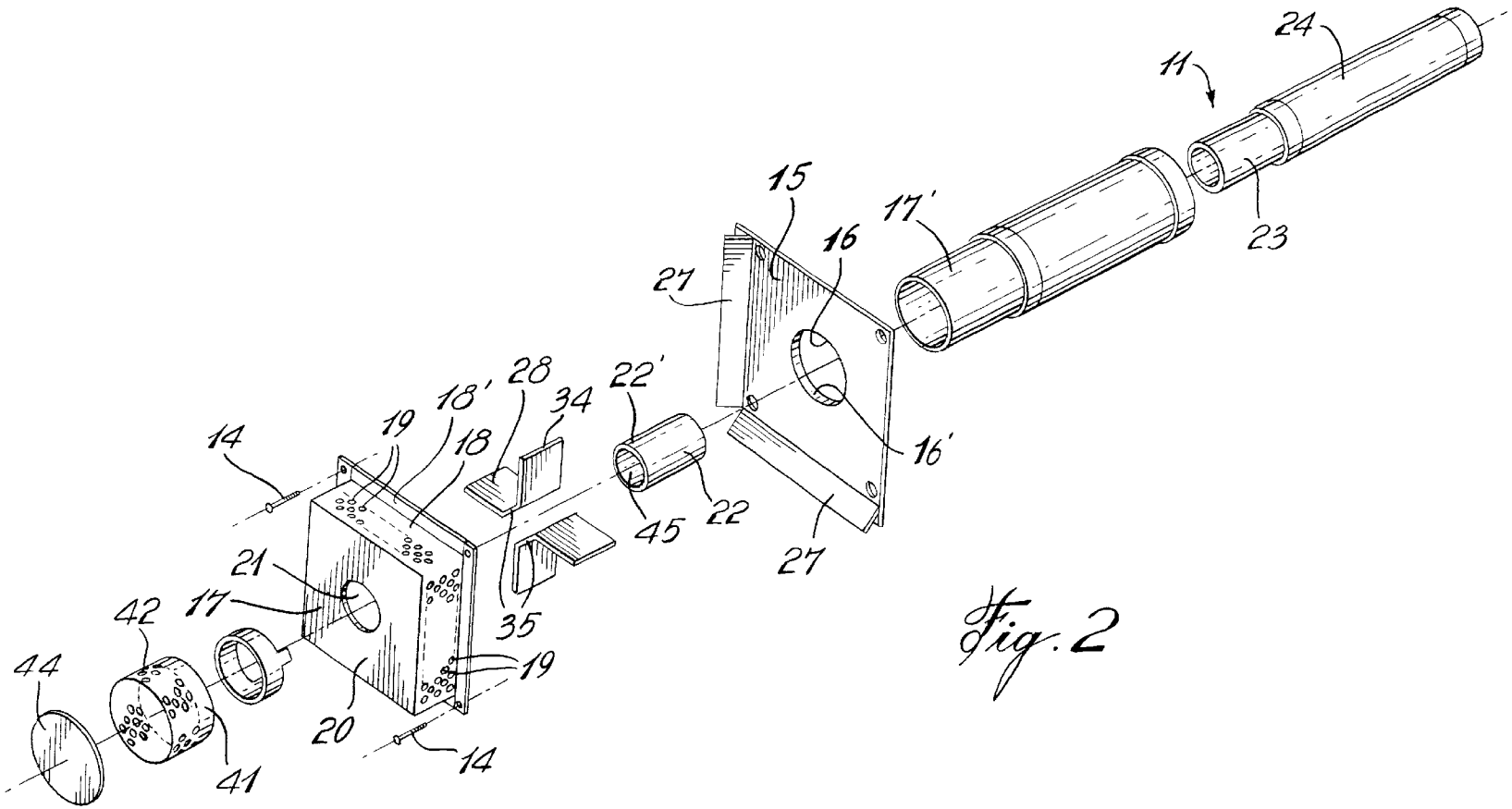
FIG. 2 is an exploded perspective view of the termination unit and a coaxial flue pipe end section.

With reference now to FIG. 2, a detailed description of the termination unit will now be described. The termination unit is comprised of a wall mounting means in the form of a square rectangular mounting plate 15. The mounting plate is provided with a circular hole 16 centrally thereof and having a circumferential flange 16' which is dimensioned to be secured about the outer sleeve 17' of the coaxial vent pipe 11 by fasteners (not shown). A fresh air chamber 17 is secured to the wall mounting plate 15 and to the outer face 13 of an outer wall. The fresh air chamber is provided with a connecting flange 18' about its side walls 18 for interconnection with the mounting plate is and for attachment to a wall surface. Holes 9 are provided in the flanges 18' to receive the fasteners 14.

The fresh air chamber 17 is hereinshown as being a squared chamber having opposed parallel flat side walls 18 with a plurality of air intake ports 19 provided therein. The air intake ports are formed as circular holes, of predetermined dimension, formed in the side walls. The number of holes is dependent on the BTU requirement of the burner of the gas combustion device. These holes in the side walls provide air dampening when a gust of outside air strikes in the area of the chamber.

The chamber also has an outer flat wall 20 which is provided with a circular hole 21 which is dimensioned for close fit about an exhaust flue pipe and herein about a horizontal exhaust flue pipe extension 22 which connects over the free end 23 of the central exhaust flue pipe 24 of the coaxial flue pipe 11. This is better illustrated in FIG. 4. The circular hole 21 is aligned concentrically with the circular hole 16 in the mounting plate 15 whereby to maintain the exhaust flue pipe extension 22 substantially concentric through the circular hole of the mounting plate for connection to the free end 23 of the exhaust flue 24.

Figure 3:
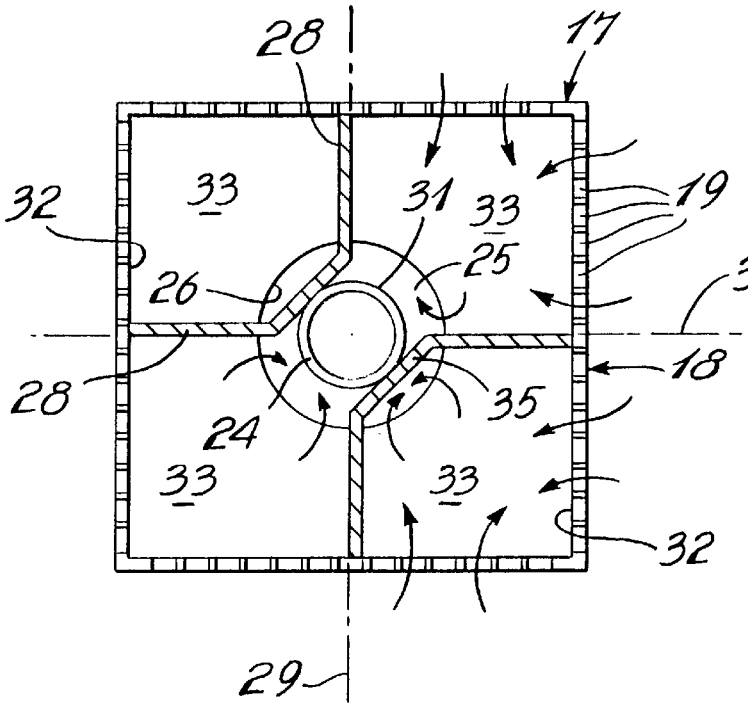
FIG. 3 is a section view through the fresh air chamber.
Figure 4:
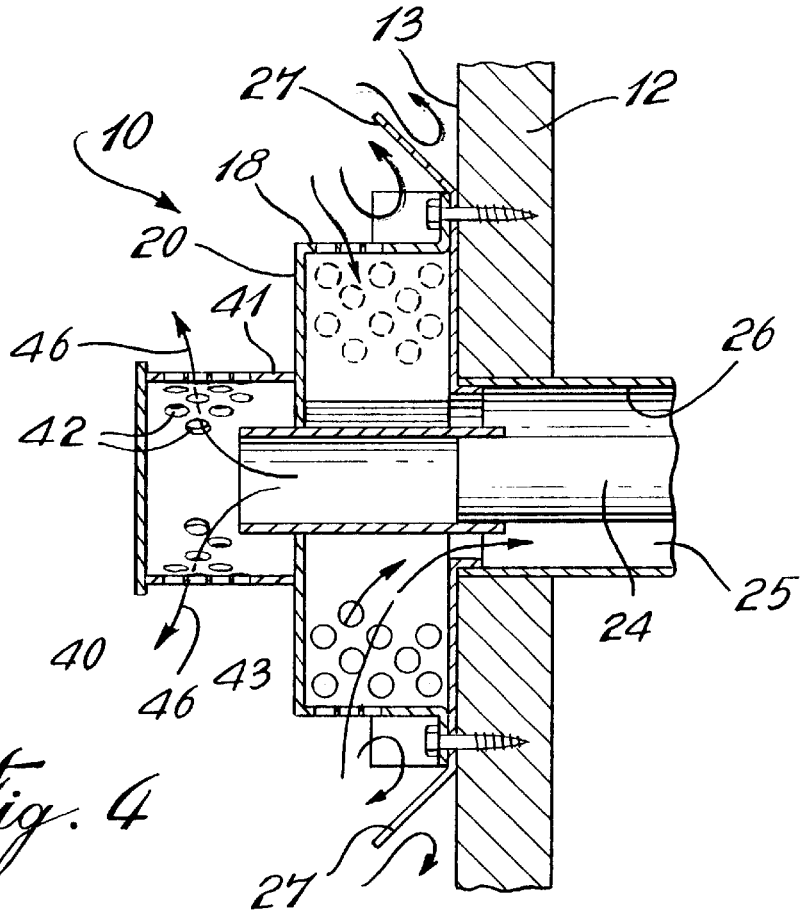
FIG. 4 is a fragmented section view of the termination unit secured to an outer wall surface and to a coaxial flue pipe extending therethrough.

With additional reference now to FIGS. 3 and 4, it can be seen that the fresh air chamber 17 is in communication with the coaxial passage 25 formed between the outer surface of the central exhaust flue pipe 24 and the inner surface 26 of the outer sleeve 17'. Accordingly, fresh air can be admitted into the chamber and into the coaxial passage 25 through the holes 19 provided in the side walls 18 of the fresh air chamber 17.

In order to dampen or baffle the air striking against the chamber 17, the mounting plate 15 is further provided with wind deflector means in the form of elongated projecting rectangular flanges 27 formed integral along each outer edge 15' of the mounting plate. As better seen in FIG. 4, these flanges 27 are spaced about the air intake ports of the chamber 17 and are disposed at a predetermined angle between an associated one of the flat side walls 18 of the chamber and the vertical wall outer surface 13. Preferably, but not exclusively, these flagons 27 extend at an angle of 45 degrees and project a predetermined distance over the side walls 18 of the fresh air chamber 17.

As better seen in FIGS. 2 to 4, air baffle means in the form of division walls 28 are further disposed on transverse central axes 29 and 30 (see FIG. 3) of the chamber 17 and extend on opposed sides of the exhaust flue pipe 24. Each of the division walls 28 extend from an outer surface 31 of the exhaust flue pipe 24 to an inner surface 32 of an associated one of the opposed parallel flat side walls 18 and terminate at mid-length of the side walls. The division walls 28 form air current damping chambers 33 disposed in quadrants of the chamber 17. As shown in FIG. 2, two of the division walls 28 are integrally formed by a plate 34 which is bent to form two transverse division wall sections 28 and an intermediate connecting wall 35. The intermediate connecting wall 35 may be tack-welded to the outer surface 31 of the exhaust flue pipe extension 22 or may be tack-welded to the inner surface 32 of the side walls 18 of the chamber. These baffles equalize pressure between the fresh air intake and the combustion gas in the combustion chamber.

As shown in FIG. 4, when wind strikes against the termination unit 10 of the present invention, it is deflected by the deflector plates 27, then further dampened by the perforated side walls 18 having the air intake ports therein and still further dampened by the baffle plates formed by the division walls 28 inside the chamber so that there is hardly any wind disturbance within the chambers 33 formed inside the fresh air chamber 17.

As shown more clearly in FIG. 4, the exhaust flue pipe extension 22 which is connected to the free end of the exhaust flue pipe 24, extends through the outer wall 20 of the chamber 17 a distance to form a terminal end section 40. A baffle cylinder 41 having holes 42 therein is concentrically secured about the terminal end section 22' of the flue pipe extension 22 and spaced thereabout by a connecting ring 43 which prevents downdraft during standby mode of the burner. The connecting ring also drastically implores combustion efficiency by improving the $CO_2$%. An air separation flange 44 is secured about the terminal end 22' immediately adjacent the open end 45 of the exhaust flue pipe extension. The open end 45 is spaced a predetermined distance from the outer wall 20 of the fresh air chamber 17 so that the flue gases will be expelled under pressure in the direction of arrow 46 and away from the intake ports of the fresh air chamber which draw their air from the circumferential top walls of the housing.

In conclusion, the combination of the wind deflector flanges, the internal baffle plates and the air intake ports will isolate the combustion chamber from air displacement capable of extinguishing a pilot flame and resulting from wind speed at said termination unit of 60 m.p.h. or more.

It is within the ambit of the present invention to cover any obvious modifications of the preferred embodiment described herein, provided such modifications fall within the scope of the appended claims.

I claim:

1. A termination unit for a through-the-wall horizontal vent of a gas combustion device having a combustion chamber and a burner, said termination unit comprising wall mounting means securable to a vertical wall outer surface and about an outer sleeve of a coaxial flue pipe, a fresh air chamber secured to said wall mounting means, an exhaust end of an exhaust flue pipe extending through said wall mounting means and said fresh air chamber to exit through an outer wall of said chamber, air intake ports in an outer peripheral wall of said chamber to supply fresh air to a coaxial passage between said exhaust flue pipe and said outer sleeve to feed said combustion chamber, air baffle means in said chamber about said exhaust end of said flue pipe extending through said chamber, and wind deflector means disposed in spaced relationship about said air intake ports of said chamber, said air baffle means being constituted by division walls disposed on transverse central axes of said chamber and disposed on opposed sides of said exhaust flue pipe, each of said division walls extending from an outer surface of said exhaust flue pipe to an inner surface of an associated one of said opposed parallel flat side wall and terminating at mid-length thereof, said division walls forming air current damping chambers inside said fresh air chamber wherein to equalize air pressure in said damping chambers to that in said combustion chamber.

2. A termination unit as claimed in claim 1 wherein the combination of said wind deflector means, said baffle means and said air intake ports will isolate said combustion chamber from a downdraft capable of extinguishing a pilot flame and resulting from wind speed at said termination unit of 60 m.p.h. or more.

3. A termination unit as claimed in claim 1 wherein said wall mounting means is a flat mounting plate having a circular hole therein dimensioned to secure about said outer sleeve of said coaxial flue pipe, said outer wall of said fresh air chamber also having a circular hole dimensioned for close fit about said exhaust flue pipe and aligned concentrically with said circular hole of said flat mounting plate whereby to maintain said flue pipe spaced substantially concentric through said circular hole of said mounting plate.

4. A termination unit as claimed in claim 3 wherein a fresh air annular inlet port is formed between a circumferential edge of said circular hole in said mounting plate and an outer peripheral surface of said exhaust flue pipe.

5. A termination unit as claimed in claim 4 wherein said wind deflector means is constituted by projecting flanges spaced about said air intake ports of said chamber.

6. A termination unit as claimed in claim 5 wherein said mounting plate is a square metal mounting plate, said fresh air chamber being a square chamber secured to said mounting plate, said chamber having opposed parallel flat side walls, said air intake ports being holes formed in at least some of said side walls.

7. A termination unit as claimed in claim 6 wherein said holes are circular holes, there being a plurality of said holes in each said flat side wall, said holes providing wind damping.

8. A termination unit as claimed in claim 7 wherein there are a predetermined number of said holes dependent on the BTU requirement of said burner, said holes having a selected diameter also dependent on the BTU of said burner.

9. A termination unit as claimed in claim 6 wherein said projecting flanges are elongated rectangular flanges formed integral with said square metal mounting plate and extending along the outer side edges of said plate, said flanges being disposed at a predetermined angle between an associated one of said flat side walls of said chamber and said vertical wall outer surface.

10. A termination unit as claimed in claim 3 wherein said exhaust flue pipe extending through said chamber is an exhaust pipe extension connected at one end to said exhaust flue pipe through a connection with said mounting plate, said exhaust pipe extension extending through said outer wall of said chamber to form a terminal end section.

11. A termination unit as claimed in claim 10 wherein a wind baffle cylinder is concentrically spaced and secured about said terminal end section adjacent an open exhaust end of said exhaust pipe extension, said open end being spaced a predetermined distance from said outer wall of said fresh air chamber, and an air separation flange about said open exhaust end.

* * * * *